US008245343B2

(12) United States Patent
Park et al.

(10) Patent No.: US 8,245,343 B2
(45) Date of Patent: Aug. 21, 2012

(54) METHOD FOR CONTROLLING A WASHING MACHINE

(75) Inventors: Eun Jin Park, Gyeongsangnam-do (KR); Deug Hee Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 700 days.

(21) Appl. No.: 12/345,875

(22) Filed: Dec. 30, 2008

(65) Prior Publication Data

US 2009/0172894 A1 Jul. 9, 2009

(30) Foreign Application Priority Data

Dec. 31, 2007 (KR) ..... 10-2007-0141560

(51) Int. Cl.
*D06F 35/00* (2006.01)
*D06F 39/00* (2006.01)

(52) U.S. Cl. ..... 8/158; 8/159

(58) Field of Classification Search ..... 8/158, 159
See application file for complete search history.

(56) References Cited

U.S. PATENT DOCUMENTS 3,672,189 A * 6/1972 High et al. ..... 68/12.21
4,175,409 A * 11/1979 Morey ..... 68/4
4,489,455 A * 12/1984 Spendel ..... 8/158
4,987,627 A * 1/1991 Cur et al. ..... 8/158
5,687,440 A * 11/1997 Min et al. ..... 8/158
5,692,259 A * 12/1997 Lee et al. ..... 8/158
5,890,247 A * 4/1999 Erickson et al. ..... 8/158
2008/0141465 A1 6/2008 Muenzner et al.
2008/0201868 A1 * 8/2008 Bang et al. ..... 8/159

FOREIGN PATENT DOCUMENTS

CN 1197865 A 11/1998
CN 1429942 A 7/2003
CN 1796646 A 7/2006
DE 18 47 014 U 2/1962
DE 10 2006 060 256 A1 6/2008
EP 1 184 505 A2 3/2002

* cited by examiner

*Primary Examiner* — Michael Barr
*Assistant Examiner* — Charles W Kling
(74) *Attorney, Agent, or Firm* — Birch, Stewart, Kolasch & Birch, LLP

(57) ABSTRACT

A method for controlling a washing machine is provided. The method for controlling a washing machine includes at least one rinsing course, wherein the rinsing course includes a foam removal rinsing step for removing foam from laundry by supplying washing water relevant to a quantity of the laundry held in a drum, or the method for controlling a washing machine includes at least one rinsing course, wherein the rinsing course includes a water supply/drain rinsing step for rinsing laundry while simultaneous washing water supply and drain is performed, whereby permitting to enhance a washing effect, significantly.

7 Claims, 2 Drawing Sheets

METHOD FOR CONTROLLING A WASHING MACHINE

This application claims the benefit of the Patent Korean Application No. 10-2007-0141560, filed on Dec. 31, 2007, which is hereby incorporated by reference as if fully set forth herein.

BACKGROUND OF THE INVENTION

1. Field of the Invention

The present invention relates to washing machines, and more particularly, to a method for controlling a washing machine, in which rinsing effect can be enhanced significantly in a rinsing course in which laundry is rinsed.

2. Discussion of the Related Art

In general, the washing machine is a home appliance for removing foreign matters from clothes. The washing machine progresses the washing through many steps of a washing course, a rinsing course, a spinning course, and so on.

In the meantime, in a related art, even if a washing machine rinses the laundry after finishing the washing in the washing course, there are frequent cases when the laundry is required to rinse again because contamination of water used in the rinsing course becomes the heavier as time passes by the more, such that the clothes of which rinsing is just finished is covered with foam and the like.

Moreover, if the rinsing course is started right after the washing course, the foam or the foreign matters contained in the laundry in the washing course is not removed easily, to require the rising again at the end.

SUMMARY OF THE INVENTION

Accordingly, the present invention is directed to a method for controlling a washing machine that substantially obviates one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling a washing machine includes at least one rinsing course, wherein the rinsing course includes a foam removal rinsing step for removing foam from laundry by supplying washing water relevant to a quantity of the laundry held in a drum, and a spinning step for removing water from the laundry.

The foam removal rinsing step includes the step of supplying the washing water, more than a quantity of the washing water relevant to the laundry, but lower than a maximum washing water level of the drum, for rinsing the laundry by rotating the drum.

The method further includes a water supply/drain rinsing step for rinsing the laundry while the washing water is supplied and drained at the same time in succession to the spinning step.

The water supply/drain rinsing step includes a step for controlling the washing machine such that the washing water supply quantity and the washing water draining quantity is the same for maintaining a fixed water level of the drum.

The water supply/drain rinsing step includes a rinsing water supply step for supplying the washing water to the drum, and a simultaneous rinsing step for making simultaneous washing water drain and supply during the drum is rotating after the step of rinsing water supply.

The simultaneous washing water drain and supply in the simultaneous rinsing is progressed for 1 to 5 minutes.

The spinning step further includes a foreign matter removal step for removing foreign matters from an inside of the tub or an outside of the drum.

The foreign matter removal step includes the step of supplying a small quantity of water between the tub and the drum for removing the foreign matters from the inside of the tub or the outside of the drum.

The foreign matter removal step is performed in a case the motor which rotates the drum is turned off, leaving the drum is rotated by an inertial force, in the spinning step.

The method further includes a general rinsing step for supplying the washing water relevant to a quantity of the laundry held in the drum and rinsing the laundry at least once in succession to the foam removal rinsing step.

The method further includes a rinsed spinning step in succession to the general rinsing step, and the rinsed spinning step includes the foreign matter removing step for removing the foreign matters from an inside of the tub or an outside of the drum.

The foreign matter removing step includes the step of supplying a small quantity of water between the tub and the drum for removing the foreign matters from the inside of the tub or the outside of the drum.

The foreign matter removing step includes the step of supplying the water when the motor which rotates the drum is turned off in the spinning step, leaving the drum to rotate by inertia force.

In another aspect of the present invention, a method for controlling a washing machine includes at least one rinsing course, wherein the rinsing course includes a water supply/drain rinsing step for rinsing laundry while simultaneous washing water supply and drain is performed.

The water supply/drain rinsing step includes the step of controlling the washing machine such that a washing water supply quantity and a washing water draining quantity is the same for maintaining a fixed water level of the washing water.

The water supply/drain rinsing step includes a rinsing water supply step for supplying the washing water to the drum, and a simultaneous rinsing step for making simultaneous washing water drain and supply during the drum rotates after the rinsing water supply step.

In another aspect of the present invention, a method for controlling a washing machine includes a washing course and a rinsing course, wherein the washing course includes a general washing step for washing laundry, and a diluted washing step for supplying clean washing water additionally without draining the washing water supplied in the general washing step, and the rinsing course includes a foam removal rinsing step for supplying clean washing water more than a quantity of the washing water relevant to a quantity of the laundry held in the drum for removing the foam from the laundry.

The diluted washing step includes the step of supplying the washing water to the washing water supplied and held in the drum for 3 to 5 minutes.

The washing course further includes a draining step for draining the washing water from the drum in succession to the diluted washing step, and a brief rinsing step for supplying the washing water to a minimum water level at which the laundry can be wet and rotating the drum.

In another aspect of the present invention, a method for controlling a washing machine includes a washing course and a rinsing course, wherein the washing course includes a general washing step for washing laundry, and a brief rinsing step for supplying the washing water to a minimum water level at which the laundry can be wet and rotating the drum, and the rinsing course includes a foam removal rinsing step for supplying clean washing water more than a quantity of the washing water relevant to a quantity of the laundry held in the drum for removing the foam from the laundry.

The rinsing course further includes a water supply/drain rinsing step for rinsing the laundry while making simultaneous washing water supply and draining in succession to the foam removal rinsing course.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
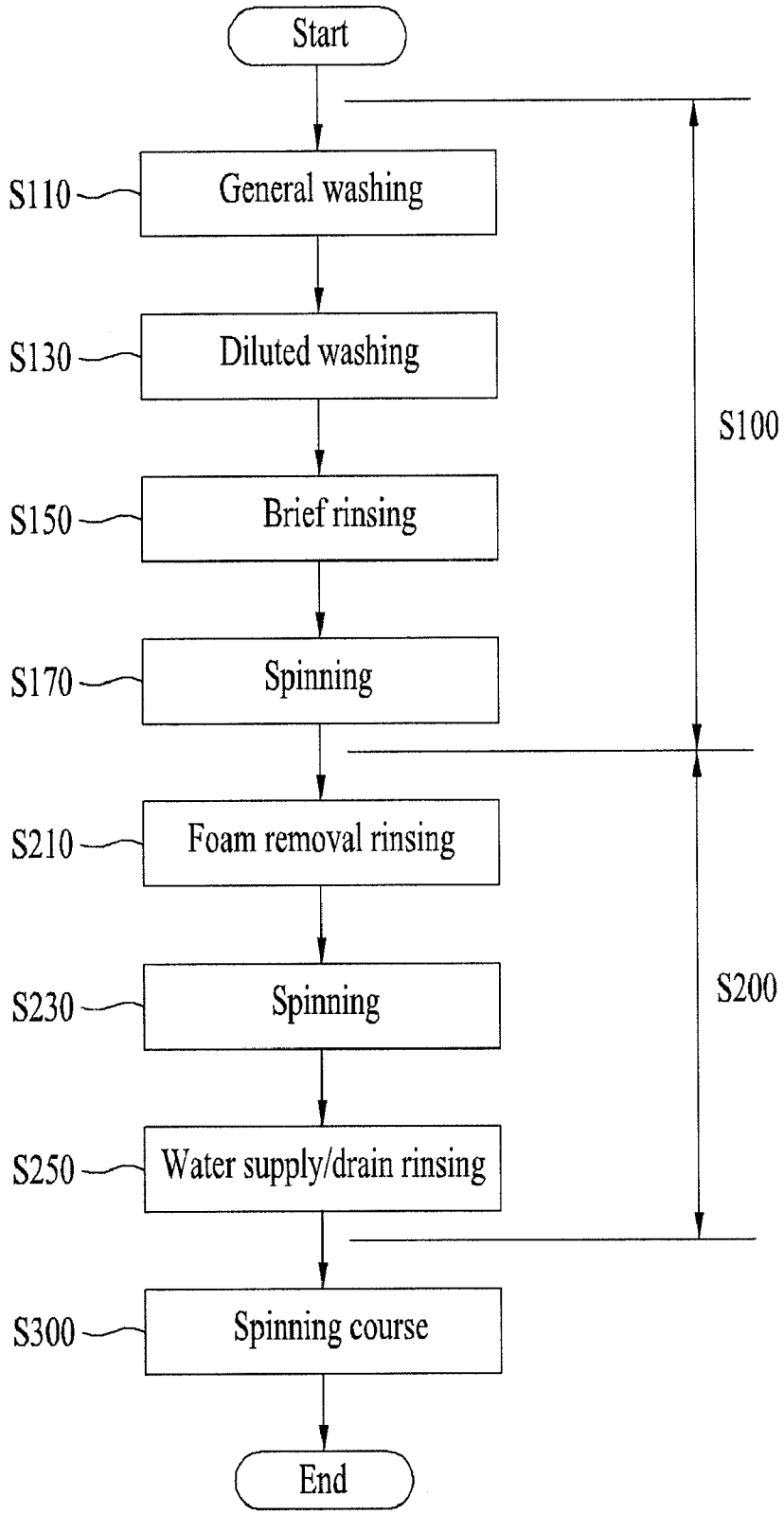
FIG. 1 illustrates a flow chart showing the steps of a method for controlling a washing machine in accordance with a preferred embodiment of the present invention.

FIG. 1 illustrates a flow chart showing the steps of a method for controlling a washing machine in accordance with a preferred embodiment of the present invention.

Referring to FIG. 1, the method for controlling a washing machine includes a washing course S100, a rinsing course S200, and a spinning course S300.

The rinsing course S200 may include a foam removal ringing step S210 for removing foam from laundry in the drum, a spinning step S230, and a water supply/draining rinsing step S250.

The rinsing course in accordance with a preferred embodiment of the present invention will be described at first, and then, the washing course will be described.

The rinsing course in accordance with a preferred embodiment of the present invention removes detergent and the foam from laundry in a drum to the maximum so that the user satisfies with a rinsing state of the rinsed laundry.

The rinsing course S200 may include a foam removal rinsing step S210 for removing foam from laundry in the drum, a spinning step S230, and a water supply/draining rinsing step S250.

Therefore, the rinsing course includes the foam removal rinsing step S210 for removing foam from the laundry.

In the foam removal rinsing step S210, it is preferable that washing water is supplied more than a quantity of the washing water relevant to the laundry in the drum. In general, the washing water is supplied relevant to the laundry in the drum in a case the rinsing course is performed. The words 'washing water supply relevant to the laundry' is a quantity of the washing water a general washing machine provides, i.e., a quantity of the washing water that can wet the laundry, adequately.

However, in the foam removal rinsing step S210, the washing water is supplied more than a quantity of the washing water relevant to the laundry. In more detail, it is preferable that the washing water is supplied, more than a quantity of the washing water relevant to the laundry, but lower than a maximum washing water level of the drum. If the washing water is supplied, more than the washing water relevant to the laundry, or lower than a maximum washing water level thus, the laundry is submerged under the washing water, completely. Therefore, if the drum is rotated in a state the laundry is submerged under the washing water completely, complete removal of the detergent and the like can be possible.

That is, since the foam removal rinsing step can perform the rinsing course after the laundry is completely submerged under the washing water, the detergent and the foam can be removed from the laundry more, effectively.

If the foam and the detergent is removed from the laundry in the foam removal rinsing step, the spinning step S230 is performed, for removing water from the laundry. In this case, a motor connected to the drum is driven to rotate the drum at a speed higher than a predetermined speed, for removing the water from the laundry by centrifugal force.

In the meantime, if the washing machine is used repeatedly, the foreign matters accumulate in a space between the tub and the drum. Particularly, if intensive, the foreign matters stuck to an outside wall of the drum or an inside wall of the tub supply bacteria or fungi which are harmful to the human body to an inside of the washing machine to cause a serious problem in which health of the user is threatened.

Therefore, it is preferable that the spinning step S230 includes a foreign matter removal step (not shown) for removing the foreign matters from the outside of the drum or the inside of the tub described before, additionally.

In the foreign matter removal step, water is supplied to the space between the tub and the drum at a low flow rate while the drum is rotating such that the water moved by rotating force of the drum collide onto the foreign matters between the drum and the tub, thereby removing the foreign matters.

In more detail, a case is assumed, in which the washing machine includes a cabinet which forms an exterior thereof, a tub in the cabinet for holding the washing water, and a drum rotatably mounted in the tub. Since the drum is rotatably mounted in the tub, the foreign matters from the laundry can present on the inside of the tub or the outside of the drum. Therefore, in the foreign matter removal step, the water is sprayed or supplied to the space between the drum and the tub which is required for rotation of the drum for removing the foreign matters from the outside of the drum or the inside of the tub. In this case, it is preferable that a system is required for supplying the water to the space between the drum and the tub.

In the meantime, supply of a large quantity of water in the foreign matter removal step can lead to supply of the water to the laundry of which spinning is performed already to remove the water therefrom again, it is preferable that the water supply in the foreign matter removal step is a low quantity not to wet the laundry, again.

Moreover, since power consumption of the motor increase if the drum is rotated additionally for removal of the foreign matters from the space between the drum and the tub, it is preferable that the water is supplied for removing the foreign matters in a case the motor is turned off in the spinning step S230.

If the motor is driven in the spinning step, the drum rotates for water extraction, and if the motor is turned off, the drum does not stop right away, but keeps rotating for a certain time period by an inertia force. Therefore, in the foreign matter removal step, the water is supplied for removing the foreign matters in a case the drum is rotating by the inertia force after the motor is turned off thus. In this case, though the water may be supplied after a predetermined time period, for an example, about 5 seconds, is passed from the turning off of the motor, it is preferable that the water is supplied for a predetermined time period, for an example, 5 to 20 seconds, at the same time with the turning off of the motor. This is because the water supply starting from right after the turning off of the motor is favorable in view of removal of the foreign matters by using the water being supplied, since the rotation speed of the drum slows down gradually if the motor is turned off.

In conclusion, the foreign matter removal step enables to prevent the laundry from wetting again, and removal of the foreign matters from a space between the drum and the tub.

In the meantime, the rinsing course progresses the water supply/drain rinsing step S250 in succession to the spinning step S230. In the water supply/drain rinsing step S250, the rinsing is performed while supplying the water to the drum and draining the water from the drum, simultaneously.

Though the rinsing is performed after the washing water is supplied to a preset level of the drum once in the related art. However, the related art rinsing course has a problem in that no consistent rinsing effect can be expected due to cleanness of the washing water which becomes the poorer as the time passes by the more due to the detergent and the like contained in the laundry. Therefore, the embodiment intends to provide a controlling method for rinsing the laundry while keeping supply of clean washing water.

The water supply/drain rinsing step S250 may include a rinsing water supply step for supplying the washing water for a preset time period to the drum, and a simultaneous rinsing step for making washing water supply/drain to/from the drum simultaneously at least for a preset time period for progressing the rinsing while maintaining a fixed water level in the drum.

In detail, in the rinsing water supply step, the washing water is supplied for the preset time period according to a quantity of the laundry such that the laundry is wet uniformly.

In the simultaneous rinsing step, while washing water supply as well as washing water draining from the tub is performed in succession to the rinsing water supply step simultaneously, to maintain the water level of the rinsing water supplied in the rinsing water supply step, the drum is rotated. In this case, a time period in which both the water supply and water drain is performed simultaneously may vary with the quantity of the laundry, and preferably about 1 to 5 minutes so that the simultaneous rinsing step is prolonged, excessively.

That is, if a fixed rate of washing water drain and clean washing water supply at the fixed rate is performed after a predetermined quantity of the washing water is supplied, the washing water level in the drum will be fixed. Moreover, since the washing water is supplied continuously, the cleanness of the washing water used in the rinsing course, not becomes the poorer as the time passes by the more, but can be maintained higher than a predetermined level, thereby permitting to improve a rinsing performance of the washing machine.

In conclusion, the water supply/drain rinsing step enables an effect in which the laundry is rinsed in flowing water.

Upon finishing the water supply/drain rinsing step S250, the washing machine finishes the rinsing course S200, and performs the spinning course S300 in succession. Since the spinning course S300 is similar to a related art spinning course, detailed description of the spinning course S300 will be omitted.

A method for controlling a washing machine in accordance with another preferred embodiment of the present invention may include a washing course S100 for washing the laundry before the rinsing course, additionally.

The washing course S100 may include a general washing step S110 for washing laundry, a diluted washing step S130 for supplying more washing water for performing washing in succession to the general washing step, and a spinning step S170.

Since the general washing step S110 is similar to the washing step of the related art washing machine in which detergent and washing water is supplied according to a quantity of the laundry, and a drum is rotated, detailed description of the general washing step S110 will be omitted.

The diluted washing step S130 successive to the general washing step S110 is a step in which the washing water supplied in the general washing step is not drained, but more clean washing water is supplied for a predetermined time period, for washing the laundry. For an example, in the diluted washing step, the washing is performed while the water is supplied for more than 3 to 5 minutes.

In the meantime, in the related art method for controlling a washing machine, the rinsing course is performed right after the washing course, when it is liable that the detergent supplied in the washing course is stuck to the laundry is not separated effectively failing to make an effective rinsing. According to this, the related art washing machine is controlled such that a rinsing course is added separately for removing the detergent from the laundry, or a time period required for the rinsing course is increased. At the end, the related art method for controlling a washing machine has a problem in that a quantity of the washing water used or a rinsing time period is increased, significantly.

Accordingly, the washing course of the embodiment includes the diluted washing step for removing the detergent from the laundry washing of which is finished at first such that the rinsing of the laundry can be made more effectively in the rinsing course which succeeds the diluted washing course.

In the diluted washing course, clean washing water is supplied to the washing water supplied to the laundry in the general washing step and held in the tub additionally for progressing the washing. This is for increasing a ratio of the washing water supplied to the laundry compared to the detergent supplied to the laundry for inducing activity of the detergent supplied to the laundry, thereby preventing the detergent from concentrating and stuck to the laundry.

That is, in the diluted washing step, the drum is rotated for washing after the clean washing water is supplied to the washing water supplied in the general washing step for a predetermined time period additionally. According to this, the detergent supplied to the laundry can be made more active, thereby preventing the detergent and the like from sticking to the laundry. Therefore, if the washing water is drained in the diluted washing step, the detergent and the like stuck to the laundry can be removed, effectively.

In the meantime, there can be the detergent and the foam stuck to a surface of the laundry even if the laundry is passed through the diluted washing step and the drain step thus. Since the detergent or the foam acts as a cause that impair an effect of the rinsing course S200 in earnest, the present invention may include a brief rinsing step 150 in succession to the diluted washing step, additionally.

In the brief rinsing step 150, a minimum quantity of the washing water is supplied to the drum, the drum is rotated to make brief rinsing, and the washing water is drained.

In detail, the quantity of the washing water supplied in the brief rinsing step 150 is a minimum quantity which can wet the laundry in the drum. The quantity of the laundry in the drum can not but vary with cases of washing, and the quantity of the washing water supplied in brief rinsing step 150 is a minimum quantity which can wet the laundry in the drum, uniformly. The supply quantity of the washing water can be determined according to the quantity of the laundry in advance by repetitive tests, and may be stored as a data table in a form of laundry quantity and water supply quantity in the control unit of the washing machine in advance. Thus, since the supply quantity of the washing water can vary with the quantity of the laundry, the specification does not define concrete water supply quantities.

A spinning step S170 may be performed after finishing the brief rinsing step, additionally. In the spinning step, the washing water is extracted from the laundry before starting the rinsing course S200, and preferably, the spinning step S170 may include a foreign matter removal step alike the spinning step S230 in the rinsing course S200 described before. Since the foreign matter removal step in the spinning step is described in the rinsing step S200 in detail already, detailed description of the foreign matter removal step will be omitted.

In the meantime, though the washing course of the embodiment describes that the brief rinsing step is performed after the general washing step and the diluted washing step, the washing course of the embodiment is not limited to this, but the washing course of the embodiment may include the general washing step, the brief rinsing step and the spinning step without the diluted washing step. In this case, it is preferable that a drain step is included additionally, for draining the washing water from the drum after finishing the general washing step. Since each of the steps of the general washing step, the brief rinsing step and the spinning step in the washing course is similar to the foregoing embodiment, detailed description of each of the steps will be omitted.

If the spinning step S170 is finished, the rinsing course S200 is started. Since the rinsing course of the embodiment is described already, detailed description of the rinsing course will be omitted.

In the meantime, it is apparent that the rinsing course is applicable not only to a case when the user performs rinsing of the laundry, but also to entire washing course including the rinsing course, i.e., the washing course, the rinsing course, and the spinning course.

Figure 2:
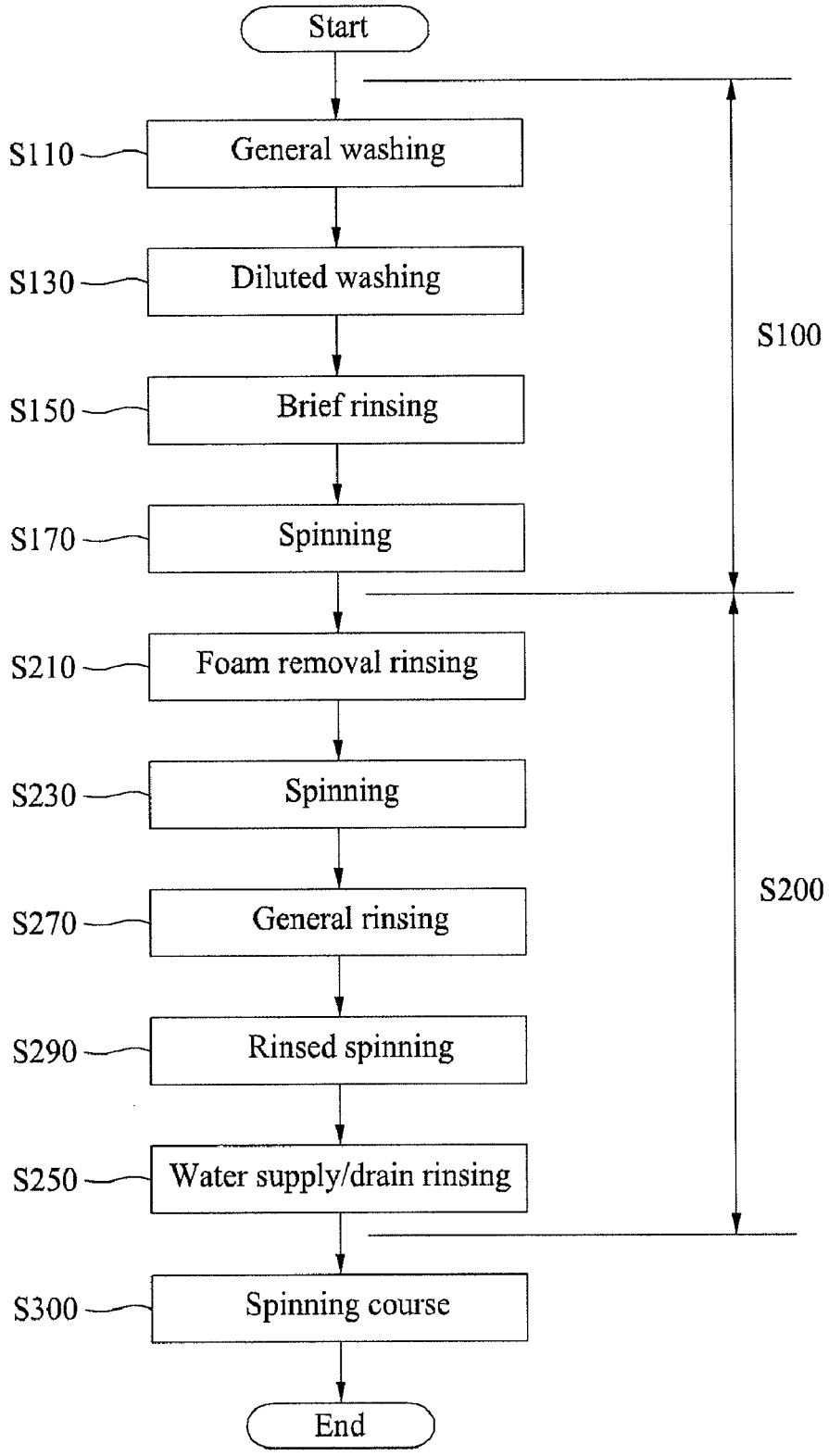
FIG. 2 illustrates a flow chart showing the steps of a method for controlling a washing machine in accordance with another preferred embodiment of the present invention.

In the meantime, FIG. 2 illustrates a flow chart showing the steps of a method for controlling a washing machine in accordance with another preferred embodiment of the present invention.

Because the method for controlling a washing machine in accordance with another preferred embodiment of the present invention is different from the embodiment described with reference to FIG. 1 in the rinsing course S200, the method for controlling a washing machine in accordance with another preferred embodiment of the present invention will be described focused on the difference.

Even if the laundry is passed through the rinsing course of the embodiment described with reference to FIG. 1, the user may not satisfy a rinsing result. In this case, in order to enhance a washing effect, the method for controlling a washing machine may include an additional step.

Referring to FIG. 2, the rinsing course may include one or more than one time of general rinsing step S270 and a spinning step S290 succeeding the general rinsing step, additionally. In order to make the spinning step S230 succeeding the foam removal rinsing step distinctive, the spinning step S290 succeeding the general rinsing step will be called as a rinsed spinning step S290.

The 'general' is a word for comparing the general rinsing step to the foam removal rinsing step, and the general rinsing step means that the washing water is supplied relevant to the quantity of the laundry for rinsing. That is, opposite to the foam removal rinsing step in which the washing water is supplied, more than a minimum quantity of the washing water relevant to the laundry, but lower than a the highest washing water level of the drum, in the general rinsing step, a quantity of the washing water a general washing machine supplies in a rinsing step, i.e., a quantity of the washing water which can wet the laundry, is supplied.

Accordingly, since the rinsing course has one or more than one time of the general rinsing step and the rinsed spinning course in succession to the foam removal rinsing step S210 and the spinning step S230, the detergent and the foam can be removed from the laundry more effectively compared to the foregoing embodiment.

In the meantime, of course, the rinsed spinning step S290 performed in succession to the general rinsing step S270 also may include a foreign matter removal step. Since the rinsed spinning step S290 is described in detail in the foregoing embodiment, detailed description thereof will be omitted.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a washing machine comprising at least one rinsing course, the rinsing course including:

a foam removal rinsing step for removing foam from laundry, and a spinning step for removing water from the laundry, wherein the spinning step further includes a foreign matter removal step for removing foreign matters from an inside of a tub or an outside of the drum, the foreign matter removal step supplying a small quantity of water between the tub and the drum, and wherein the foreign matter removal step is performed in a case where a motor which rotates the drum is turned off, leaving the drum to rotate by an inertial force, in the spinning step.

2. A method for controlling a washing machine comprising at least one rinsing course, the rinsing course including:

a foam removal rinsing step for removing foam from laundry, and a spinning step for removing water from the laundry, wherein the foam removal rinsing step includes a step of supplying washing water into a drum for rinsing the laundry by rotating the drum, where the washing water is supplied in an amount greater than a quantity of the washing water necessary to wet the laundry held in the drum so as to submerge the laundry under the washing water completely, and the amount is lower than a maximum washing water level of the drum, wherein the spinning step further includes a foreign matter removal step for removing foreign matters from an inside of a tub or an outside of the drum, the foreign matter removal step supplying a small quantity of water between the tub and the drum, and wherein the foreign matter removal step is performed in a case where a motor which rotates the drum is turned off, leaving the drum to rotate by an inertial force, in the spinning step.

3. The method as claimed in claim 2, further comprising a water supply/drain rinsing step for rinsing the laundry while the washing water is supplied and drained at the same time after the spinning step.

4. The method as claimed in claim 3, wherein the water supply/drain rinsing step includes a step for controlling the washing machine such that the washing water supply quantity and a washing water draining quantity is the same for maintaining a fixed water level of the drum.

5. The method as claimed in claim 3, wherein the water supply/drain rinsing step includes;

a rinsing water supply step for supplying the washing water to the drum, and a simultaneous rinsing step for making a simultaneous washing water drain and supply while the drum is rotating after the step of rinsing water supply.

6. The method as claimed in claim 5, wherein the simultaneous washing water drain and supply in the simultaneous rinsing is progressed for 1 to 5 minutes.

7. The method as claimed in claim 3, further comprising a general rinsing step for supplying the washing water relevant to a quantity of the laundry held in the drum and rinsing the laundry at least once after the foam removal rinsing step.

* * * * *